US009765608B2

(12) United States Patent
Sims et al.

(10) Patent No.: US 9,765,608 B2
(45) Date of Patent: Sep. 19, 2017

(54) DUAL GRAVITY GAS SEPARATORS FOR WELL PUMP

(71) Applicant: Baker Hughes Incorporated, Houston, TX (US)

(72) Inventors: Rachel Sims, Texas City, TX (US); Artur Solodkiy, Kingwood, TX (US); Leslie C. Reid, Coweta, OK (US); Jeffrey S. Bridges, Edmond, OK (US); Jordan D. Kirk, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/987,929

(22) Filed: Jan. 5, 2016

(65) Prior Publication Data

US 2016/0222773 A1 Aug. 4, 2016

Related U.S. Application Data

(60) Provisional application No. 62/111,282, filed on Feb. 3, 2015.

(51) Int. Cl.
*E21B 43/38* (2006.01)
*E21B 43/12* (2006.01)

(52) U.S. Cl.
CPC ..... *E21B 43/38* (2013.01); *E21B 43/121* (2013.01)

(58) Field of Classification Search
CPC ..... E21B 43/121; E21B 43/38
See application file for complete search history.

(56) References Cited

U.S. PATENT DOCUMENTS 4,187,912 A * 2/1980 Cramer ..... E21B 43/121 166/107
4,998,585 A * 3/1991 Newcomer ..... B01D 17/0214 166/105

(Continued)

FOREIGN PATENT DOCUMENTS

CA 2417367 A1 * 7/2003 ..... E21B 43/121

OTHER PUBLICATIONS

International Search Report and Written Opinion for related PCT application PCT/US2016/015534 dated Jun. 23, 2016.

(Continued)

*Primary Examiner* — James G Sayre
(74) *Attorney, Agent, or Firm* — Bracewell LLP; James E. Bradley

(57) ABSTRACT

A lower separator located below a submersible well pump intake has a labyrinth flow path, causing a first well fluid separation of lighter components from heavier components as well fluid flowing into the lower separator turns downward to flow toward a lower separator heavier component port. A bypass riser has a bypass riser inlet below the pump intake and a bypass riser outlet above the pump intake. A lighter component conduit communicates the bypass riser inlet with lighter components of the first well fluid separation, causing a second well fluid separation at the riser outlet as a heavier portion of the lighter components flowing up the riser turn to flow downward to the pump intake. A heavier component conduit bypasses the bypass riser inlet and delivers the heavier components of the first well fluid separation to the pump intake.

19 Claims, 4 Drawing Sheets

(56) References Cited

U.S. PATENT DOCUMENTS

| | | | | |
|---|---|---|---|---|
| 5,482,117 | A * | 1/1996 | Kolpak | E21B 43/38 166/105.5 |
| 6,550,535 | B1 | 4/2003 | Trayoer | |
| 6,932,160 | B2 | 8/2005 | Murray | |
| 8,141,625 | B2 | 3/2012 | Reid | |
| 2002/0023750 | A1* | 2/2002 | Lopes | E21B 43/38 166/265 |
| 2004/0238179 | A1* | 12/2004 | Murray | E21B 43/38 166/369 |
| 2005/0034871 | A1 | 2/2005 | Scarsdale | |
| 2010/0319926 | A1 | 12/2010 | Reid | |
| 2016/0130922 | A1* | 5/2016 | Wilson | E21B 43/128 166/369 |
| 2016/0222770 | A1* | 8/2016 | Kirk | E21B 43/128 |

OTHER PUBLICATIONS

U.S. Appl. No. 14/537,381, filed Nov. 10, 2014, Inventors: Brown Lyle Wilson and Donn J. Brown, entitled, "Coaxial Gas Riser for Submersible Well Pump".

U.S. Appl. No. 14/984,623, filed Dec. 30, 2015, inventors: Jordan D. Kirk, Leslie C. Reid and Brown Lyle Wilson, entitled: "Charge Pump for Gravity Gas Separator of Well Pump".

* cited by examiner

DUAL GRAVITY GAS SEPARATORS FOR WELL PUMP

CROSS REFERENCE TO RELATED APPLICATION

This application claims priority to provisional application 62/111,282 filed Feb. 3, 2015.

FIELD OF THE DISCLOSURE

This disclosure relates in general to hydrocarbon well pumps and in particular to an assembly that includes two gravity gas separators in parallel upstream from a pump intake of the pump.

BACKGROUND

Electrical submersible pumps (ESP) are often employed to pump well fluid from wells. A typical ESP includes a rotary pump driven by an electrical motor. Normally, the ESP is suspended in the well on a string of production tubing. A seal section, usually located between the motor and the pump, has a movable element to reduce a pressure differential between the well fluid exterior of the motor and motor lubricant contained in the motor. The pump may be a centrifugal pump having a plurality of stages, each stage having an impeller and a diffuser.

Some wells produce gas along with liquid, and centrifugal pumps operate best when pumping primarily liquid. Gas separators of various types may be employed to separate the gas from the liquid prior to reaching the pump. However, some gas may still reach the pump, particularly when the well fluid contains slugs or large bubbles of gas.

Shrouds may be employed in various ways to cause gas separation before reaching the pump intake. In one design, the shroud surrounds the pump and has an inlet at an upper end. Well fluid flows upward around the shroud, then downward into the inlet and to the pump intake. As the well fluid turns to flow downward, gas in the well fluid tends to continue flowing upward while the heavier liquid portions flow downward into the shroud inlet.

U.S. Pat. No. 6,932,160 discloses a system using a bypass riser offset from a longitudinal axis of the ESP. The riser has an inlet extending through a barrier in the well below the pump intake. The riser has an outlet above the pump intake. As well fluid discharges from the bypass tube outlet, the gas portions tend to continue flowing upward while the liquid portions flow downward to the pump intake. The bypass tube may have helical vanes within to enhance separation of the gas and liquid portions.

SUMMARY

A well pump assembly, comprises a pump suspended on a string of production tubing within casing in a well, the pump having a pump intake and a pump discharge for discharging into the production tubing. A motor operatively coupled to the pump drives the pump. A lower separator located below the pump intake has a labyrinth flow path that causes a separation of lighter components from heavier components of well fluid flowing into the lower separator. A bypass riser extends from below the pump intake to above the pump intake. The bypass riser has an inlet below the pump intake that receives lighter components of the well fluid separated by the lower separator. The bypass riser has a bypass riser outlet above the pump intake, causing a heavier portion of the lighter components flowing up the bypass riser to turn and flow downward at the bypass riser outlet to reach the pump intake. The lower separator has a heavier component port in fluid communication with the pump intake via a flow path that that bypasses the inlet of the bypass riser.

In some embodiments, the lower separator has a lower separator inlet located above the heavier component port. In other embodiments, the lower separator has a lower separator inlet below the heavier component port.

In some of the embodiments, the lower separator comprises a cylinder having a closed lower end and an inlet opening above the lower end. A heavier component conduit located in the cylinder has a heavier component opening adjacent and above the closed lower end that serves as the heavier component port of the lower gas separating device. The position of the heavier component port requires well fluid flowing into the inlet opening of the cylinder to flow downward in the cylinder to reach the heavier component opening in the heavier component conduit.

In some of the embodiments, a lower barrier seals in the casing, defining a lower end of a lower annulus that contains the lower gas separating device. The lower barrier has a lower barrier passage therethrough that delivers all of the well fluid flowing upward from below the lower barrier to the lower separator. The lower separator causes lighter components of the well fluid to enter the lower annulus.

In some of the embodiments, an upper barrier seals in the casing above the lower barrier and below the pump intake, defining an upper end of a lower annulus and a lower end of an upper annulus. The upper barrier has a lighter component passage that delivers the lighter components from the lower annulus to the inlet of the bypass riser. A heavier component passage in the upper barrier communicates the heavier component port of the lower separator into the upper annulus. The pump intake is in fluid communication with the upper annulus.

In another embodiment, a barrier seals the casing between the lower separator and the inlet of the bypass riser. The lower separator comprises a cylinder having a closed upper end, a closed lower end and apertures in a side wall for admitting well fluid. A heavier component conduit located in the cylinder has an opening adjacent the closed lower end that serves as the heavier component port of the lower separator. A lighter component conduit extends from the closed upper end scalingly through the barrier.

In some of the embodiments, the lower separator comprises a lower labyrinth tube having an open upper end. An upper labyrinth tube having an open lower end located below the upper end of the lower labyrinth tube serves as the heavier component port of the lower separator.

In some of the embodiments, a barrier seals in the casing above the lower separator. The barrier has a heavier component passage therethrough in fluid communication with the heavier component port of the lower separator. The barrier has a lighter component passage therethrough in fluid communication with the inlet of the bypass riser.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification.

It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1A:
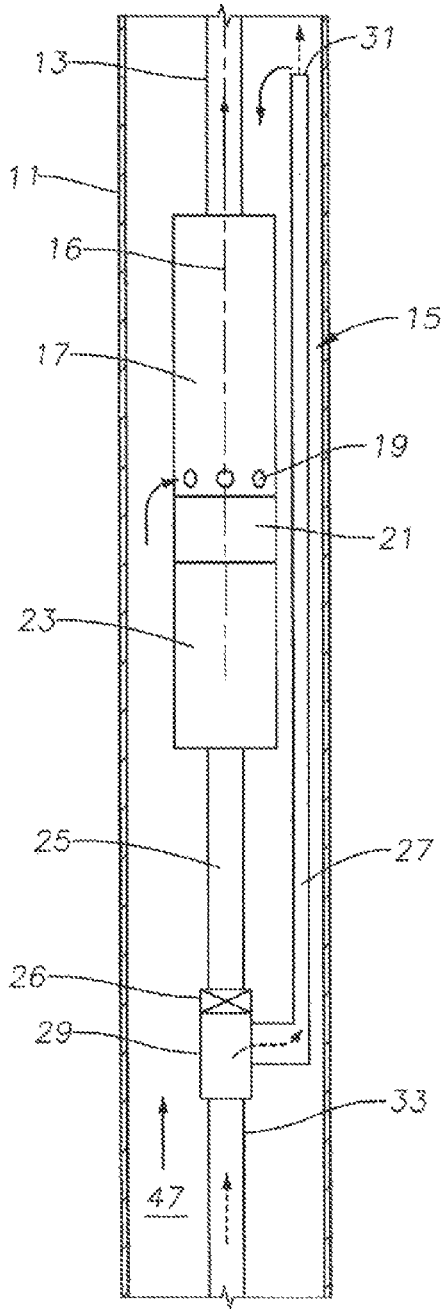
FIGS. 1A and 1B comprise a schematic side view of a first embodiment of a pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a genetic and descriptive sense only and not for the purpose of limitation.

Referring to FIG. 1A, the well has casing 11 cemented within. Casing 11 has perforations (not shown) or other openings to admit well fluid. A string of production tubing 13 extends downward from a wellhead assembly (not shown) at the upper end of the well. Production tubing 13 supports an electrical submersible pump assembly (ESP) 15, which has a longitudinal axis 16.

ESP 15 includes a pump 17, which is normally a centrifugal pump having a large number of stages, each stage having an impeller and a diffuser. Pump 17 has a pump intake 19 at its lower end and a discharge at its upper end that discharges into production tubing 13. A conventional rotary gas separator (not shown) optionally may be coupled to the lower end of pump 17. In that event, pump intake 19 would be at the lower end of the rotary gas separator.

ESP 15 has a pressure equalizer or seal section 21 that is shown connected to the lower end of pump 17. A motor 23 secures to the lower end of seal section 21. Motor 23 is preferably a three-phase electrical motor filled with a dielectric lubricant. Seal section 23 has a movable element, such as a bag or bellows, that has one side in fluid communication with the dielectric lubricant and another side in contact with exterior well fluid to reduce a pressure differential between the lubricant in motor 23 and the well fluid on the exterior of motor 23. Seal section 21 could be mounted to a lower end of motor 23. Motor 23 rotates a drive shaft that extends in sections through seal section 21 and into pump 17 to rotate the impellers within pump 17. A power cable with a motor lead (not shown) on its lower end extends alongside production tubing 13 to motor 23 to supply power.

A support rod or member 25 extends downward from the lower end of motor 23 along axis 16. Support member 25 may be a tube, but it does not convey fluid in this embodiment as it has a closed lower end 26. Support member 25 supports a bypass member, which in this example comprises a bypass conduit or riser 27. Bypass riser 27 extends alongside motor 23, seal section 21 and pump 17. Bypass riser 27 is parallel with ESP axis 16 and has an open upper end 31 located above pump intake 19. Preferably bypass riser open end 31 is above the upper end of pump 17, and it may be a considerable distance above pump 17. Clamps (not shown) may be employed to clamp bypass riser 27 to ESP 15. Bypass riser 27 may have a cross section that is crescent shaped to increase the flow area over a circular cross section.

Bypass riser 27 has a lower end with a tubular connector 29 that secures to the lower end of support member 25. Connector 29 has a lower end that secures to a riser inlet tube 33 extending downward along axis 16 of ESP 15.

Figure 1B:
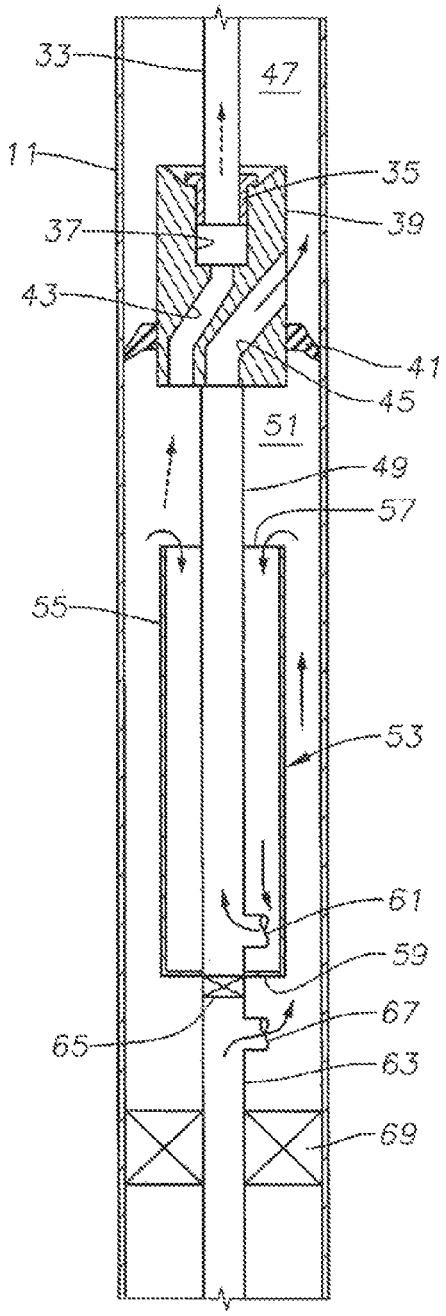

Referring to FIG. 1B, in this embodiment, riser inlet tube 33 has a stinger 35 on its lower end that stabs sealingly into a receptacle 37 of an upper barrier 39. In this example, upper barrier 39 has an annular elastomeric cup shaped seal 41 that seals to the inner diameter of casing 11. Seal 41 slides down casing 11 as upper barrier 39 is being installed. Seal 41 blocks any flow of well fluid in an upward direction around upper barrier 3. Alternatively, upper barrier 39 could be another type, such as one that swells to seal against casing 11 after being run in.

Upper barrier 39 has a lighter component passage 43 and a heavier component passage 45, both extending from the lower end to the upper end of upper barrier 39. In this example, both lighter component passage 43 and heavier component passage 45 are inclined relative to ESP axis 16. Lighter component passage 43 joins receptacle 37 to convey lighter or more gaseous components of well fluid, indicated by the dashed line arrows, into riser inlet tube 33. Heavier component passage 45 discharges heavier or more liquid components of well fluid, indicated by the solid line arrows, into an upper annulus 47. Upper annulus 47 comprises an annular space surrounding riser inlet tube 33, bypass riser 27, support member 25, ESP 15 and production tubing 13. Upper barrier 39 and its seal 41 define the lower end of upper annulus 47.

A heavier component conduit 49 is seemed to and extends downward from upper barrier 39 along ESP axis 16. The upper end of heavier component conduit 49 joins the lower end of heavier component passage 45 in upper barrier 39. A lower annulus 51 surrounds heavier component conduit 49 and is defined on its upper end by upper barrier 39.

Lower annulus 51 contains a lower gas separating device or separator 53 that is a static, non rotating type. Lower separator 53 separates gas from liquid in the well fluid by gravity. In this embodiment, lower gas separating device 53 comprises a gas anchor made up of heavier component conduit 49 and a cylinder 55 surrounding heavier component conduit 49. Cylinder 55 has an open upper end 57 in fluid communication with the well fluid in lower annulus 51. Cylinder 55 has a closed lower end 59 that is scaled to heavier component conduit 49. Cylinder 55 is larger in diameter than heavier component conduit 49, defining an inner annulus into which heavier components of well fluid flow. A conduit opening 61 in heavier component conduit 49 near closed lower end 59 serves as a heavier component port for lower gas separating device 53.

Cylinder 55 and opening 61 in heavier component conduit 49 create a labyrinth or tortuous flow path for well fluid. Heavier component well fluid flowing into cylinder open upper end 57 flows to the bottom of cylinder 55, then into and up heavier component conduit 49 via opening 61, as indicated by the solid line arrows. Lighter components of the well fluid separate at cylinder opening 57 and flow upward, as indicated by the dashed line arrows.

An inlet conduit 63 extends downward from lower gas separating device 53 along ESP axis 16. Inlet conduit 63 may be a lower portion of heavier component conduit 49, but it has a closed upper end 65, preventing the well fluid flowing up inlet conduit 63 from directly entering heavier component conduit 49. Inlet conduit 63 has an outlet 67 in its side wall that discharges all of the well fluid into lower annulus 51.

Inlet conduit 63 extends through a mating passage in a lower barrier 69 that seals to casing 11. Lower barrier 69 may be a weight supporting packer that is run in while contracted, then expanded to set in casing 11. Perforations (not shown) or other openings in casing 11 below lower barrier 69 adroit well fluid into casing 11. All of the upward flowing well fluid flows through inlet conduit 63 into lower annulus 51. A sand excluder could be mounted to the lower end of inlet conduit 63. Lower barrier 69 defines a lower end of lower annulus 51.

During installation, in the embodiment of FIGS. 1A and 1B, lower barrier 69 will be secured to lower gas separating device 53 with inlet conduit 63, and upper barrier 39 will be secured to heavier component conduit 49, defining a first sub assembly. The operator lowers the first sub assembly into casing 11 and sets lower barrier 69 at a desired location below a static level of well fluid in casing 11. Lower barrier 69 will support the weight of the first sub assembly. Inlet conduit 63 and heavier component conduit 49 will maintain upper barrier 39 and its seal 41 at a fixed distance above lower barrier 69.

Then the operator secures riser inlet tube 33 and bypass riser 27 to support member 25, and secures support member 25 to motor 23, defining a second sub assembly. The operator connects production tubing 13 to the upper end of ESP 15 and lowers the second sub assembly into casing 11. The operator stabs stinger 35 of the second sub assembly into upper barrier receptacle 39.

During operation, motor 23 drives pump 17, which draws well fluid from a lower portion of upper annulus 47 into pump intake 19. Well fluid flows up casing 11 and through inlet conduit 63 into lower annulus 51 to undergo a first well fluid separation. The heavier components of the well fluid flowing into lower annulus 51 flow into lower gas separating device cylinder 55. As the well fluid turns down to enter cylinder open upper end 57, lighter gaseous components, shown by the dashed line arrows, will separate due to gravity. The heavier more liquid components, shown by the solid line arrows, will flow up heavier component conduit 49.

The heavier components pass through upper barrier heavier component passage 45 into lower annulus 47, and from there directly to pump intake 19, bypassing bypass riser 27. The lighter components pass through upper barrier lighter component passage 43 into bypass riser inlet tube 33. The lighter components flow up bypass riser 27, bypassing pump intake 19. The lighter components flow out the open upper end of bypass riser 27 and again undergo a second well fluid separation. The lighter portion of the lighter component fluid exiting open upper end 31 continues flowing upward in casing 11 in upper annulus 47 around tubing 13 and is collected at the wellhead assembly. The heavier portion of the fluid exiting bypass riser upper end 31 is drawn downward to pump intake 19, where it mixes with the heavier component well fluid that entered upper annulus 47 via heavier component passage 45 in upper barrier 39.

The system described creates two separate flow paths from lower barrier 69 to pump intake 19 that may be considered to be in parallel. For example, if bypass riser 27 becomes temporarily choked with gaseous well fluid, perhaps due to a large gas bubble, well fluid continues to flow along a flow path to pump intake 19 via heavier component conduit 49 and heavier component passage 45 in upper harrier 39. In that event, pump intake 19 may be receiving a well fluid with a higher gas content than desired because possibly more gas than desired may flow through lower gas separating device 53; however, pump 17 can accommodate a certain amount of gas, particular if a rotary gas separator is installed below pump 17. The minimum flow area of the flow path created by lower gas separating device 53, heavier component conduit 49 and heavier component passage 45 may be greater than the minimum flow area of the flow path created by lighter component passage 43, riser inlet tube 33, connector 29 and bypass riser 27.

Figure 2A:
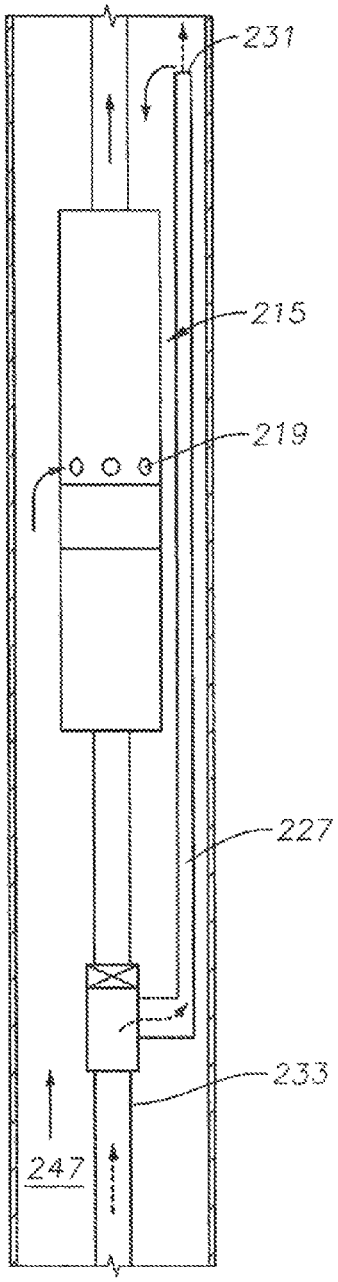
FIGS. 2A and 2B comprise a schematic side view of a second embodiment of a pump assembly in accordance with this disclosure.
Figure 2B:
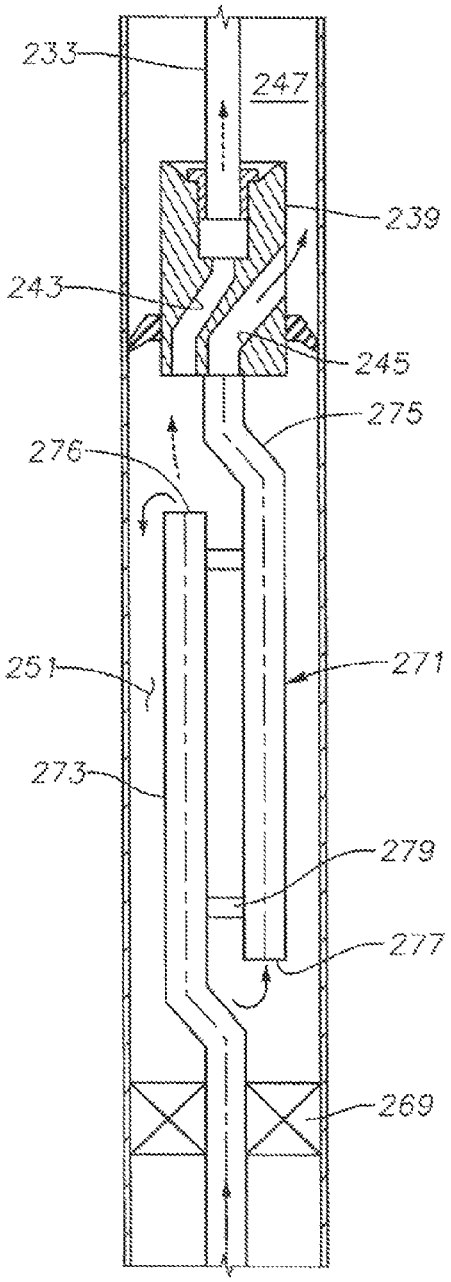

Referring to FIGS. 2A and 2B, little if any discussion of the components that are the same as in FIGS. 1A and 1B will be made. The components in common may have the same reference numerals as in FIGS. 1A and 1B, but with a prefix of the number "2". Referring to FIG. 2B, lower gas separating device 271 performs the same function as lower gas separating device 53 of FIG. 1B, but has different structure. Lower gas separating device 271 is also a labyrinth type of device, having a lower labyrinth tube 273 extending up from lower barrier 269. Lower labyrinth tube 273 receives all of the well fluid flowing upward to lower barrier 269 and has an open upper end 276 in lower annulus 251. An upper labyrinth tube 275 is offset from lower labyrinth tube 273 and has an open lower end 277 in lower annulus 251. The upper end of upper labyrinth tube 275 connects to heavier component passage 245 in upper barrier 239. Upper labyrinth tube open lower end 277 is located at an elevation below lower labyrinth tube open upper end 276. Braces 279 may connect lower labyrinth tube 273 with upper labyrinth tube

275. The remaining components of the second embodiment are the same as in the first embodiment.

During the installation of the embodiment of FIGS. 2A and 2B, lower barrier 269, lower gas separating device 271 and upper barrier 239 are secured together and installed as a first subassembly. Then, ESP 215, bypass riser 227 and riser tube 233 are assembled as a second subassembly. The operator lowers the second sub assembly into the well and stabs riser tube 233 into upper barrier 239.

During operation of the embodiment of FIGS. 2A and 2B, the well fluid is first separated into heavier and lighter components by lower gas separating device 271. The heavier components exiting open upper end 276 of lower labyrinth tube 273 must travel downward in lower annulus 251 to reach open lower end 277 of upper labyrinth tube 275. The heavier components flow through heavier component passage 245 in upper barrier 239 into upper annulus 247 and directly to pump intake 219. The lighter components in lower annulus 251 pass through lighter component passage 243 into bypass inlet tube 233 and bypass riser 227, then exit bypass riser open upper end 231. A second separation occurs at that point, with heavier components flowing down to pump intake 219 and even lighter components flowing up the well.

Figure 3A:
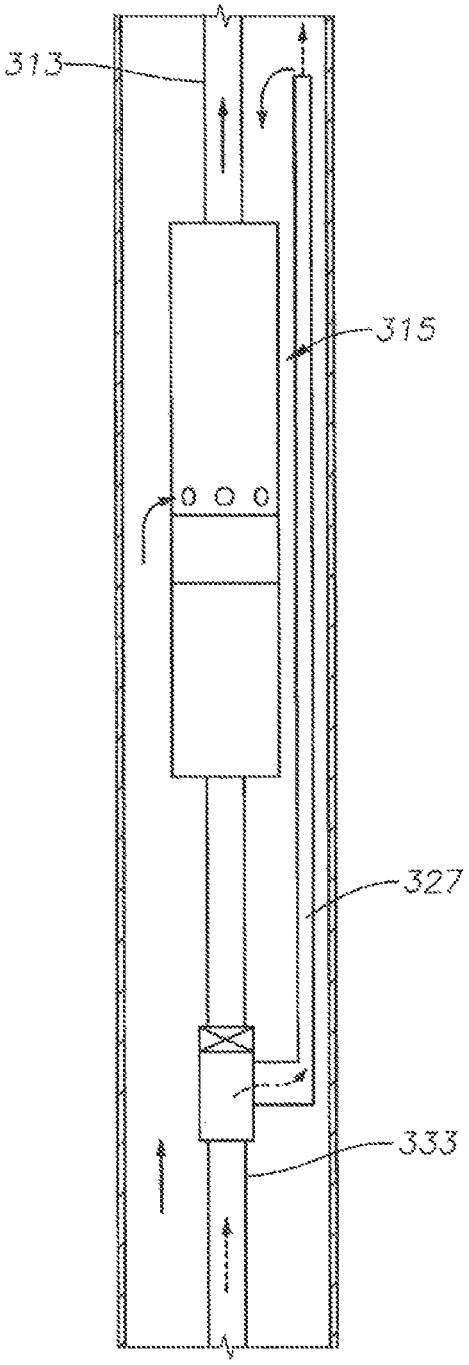
FIGS. 3A and 3B comprise a schematic side view of a third embodiment of a pump assembly in accordance with this disclosure.
Figure 3B:
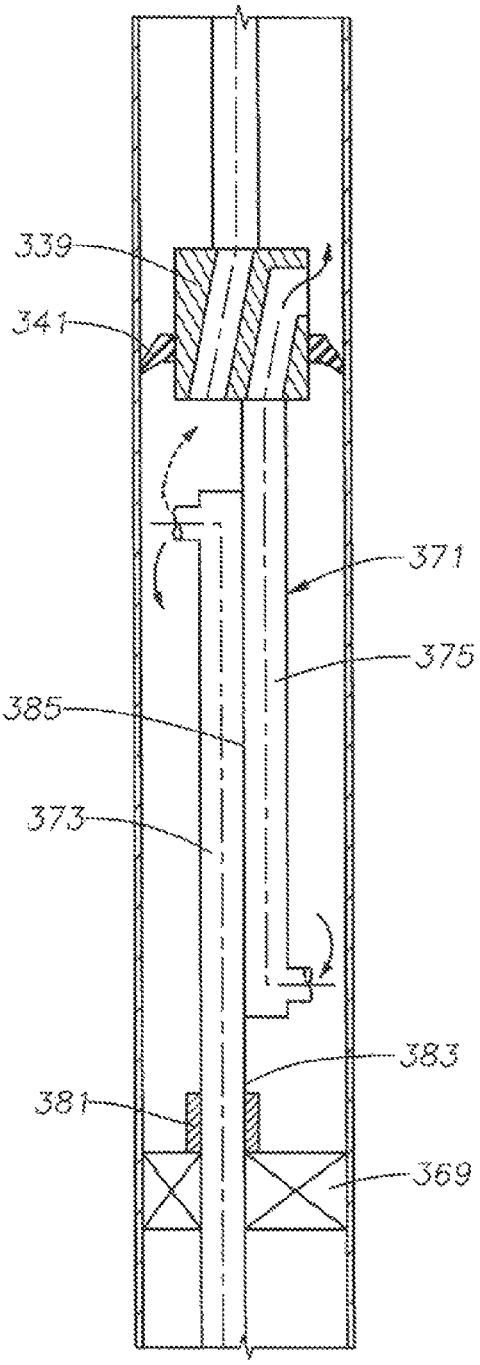

Referring to FIGS. 3A and 3B, little if any discussion of the components that are the same as in FIGS. 1A and 1B or FIGS. 2A and 2B will be made. The common components may have similar reference numerals as in FIGS. 1A and 1B, or FIGS. 2A and 2B, but with a prefix of the number "3". The embodiment of FIGS. 3A and 3B may be installed in a different manner than the other two embodiments. Referring to FIG. 3B, lower gas separating device 371 may be the same labyrinth tube type as in FIG. 2B. Alternately, lower gas separating device 371 could be a gas anchor type similar to tower gas separating device 53 of FIG. 1A. Lower labyrinth tube 373 is not rigidly secured to lower barrier 369; rather the lower end of lower labyrinth tube 373 stabs into a receptacle 381 on the upper end of lower barrier 369. Also, rather than braces 279 (FIG. 2B), a weld 385 is illustrated as connecting lower labyrinth tube 373 to upper labyrinth tube 375.

During installation of the embodiment of FIGS. 3A and 3B, lower barrier 369 is installed and set first. Then, lower gas separating device 371, upper barrier 339, bypass tube inlet 333, bypass riser 327 and ESP 315 are assembled together as a sub assembly and connected to production tubing 313. The operator lowers the sub assembly and stabs stinger 383 into receptacle 381 on lower barrier 369. The operation will be the same as the embodiment of FIGS. 2A and 2B.

In another alternate embodiment, not shown, lower barrier 369 is not installed initially as a weight bearing packer. Rather, lower barrier 369 is run with the sub assembly including lower gas separating device 371, upper barrier 339, bypass tube inlet 333, bypass riser 327 and ESP 315. In that instance, lower barrier 369 could comprise a cup-shaped seal similar to seal 341 of upper barrier 339 or another type.

Figure 4:
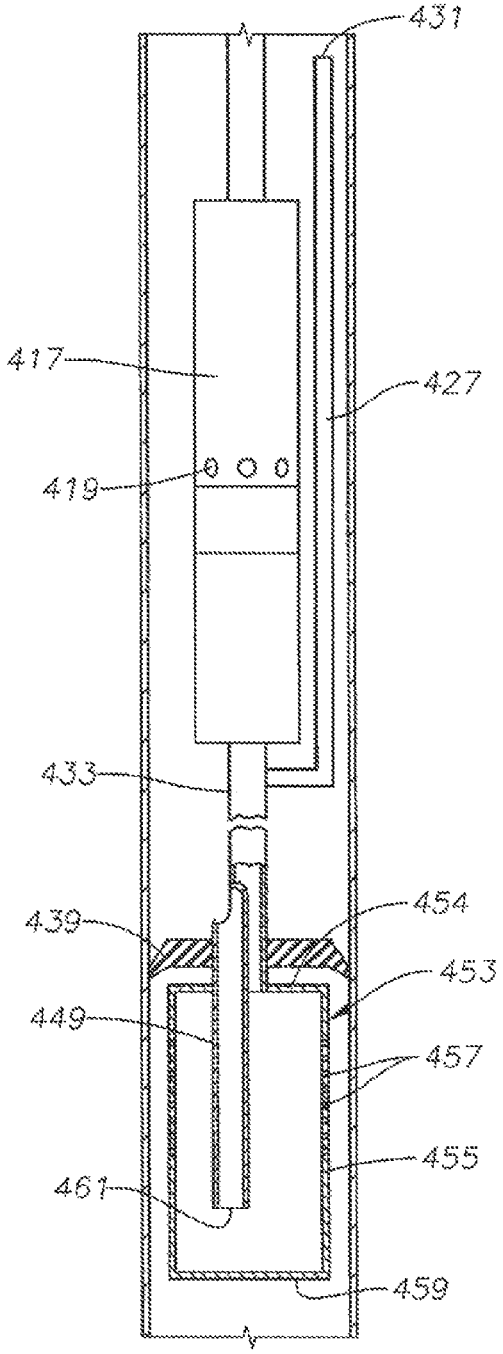
FIG. 4 is a schematic side view of a fourth embodiment of a pump assembly in accordance with this disclosure.

Referring to FIG. 4, pump 417 has a pump intake 419. A bypass riser 427 extends alongside pump 417 and has an outlet 431 above pump intake 419. A bypass riser inlet tube 433 joins the lower end of bypass riser 427 and extends downward sealingly through a barrier 439. Barrier 439 is illustrated as a cup seal. A heavier component conduit 449 extends sealingly through barrier 439 and downward.

A lower separator 453 is located below barrier 439. Lower separator 453 has a cylinder 455 with apertures 457 in its side wall. Cylinder 455 has a closed upper end 454 and a closed lower end 459. Heavier component conduit 449 has a heavier component port 461 on its lower end a short distance above closed lower end 459 and below apertures 457. Bypass outlet tube 433 extends sealingly through barrier 439 and closed upper end 454. A sand excluder screen (not shown) may be included with lower separator 453.

In FIG. 4, pump 417, bypass riser 427, barrier 439 and lower separator 453 are connected together prior to running the assembly into the well. The operator then runs the assembly into the well in a single trip.

In the operation of the embodiment of FIG. 4, well fluid flows in apertures 457 and undergoes a first separation as heavier components flow downward to heavier component port 461. The heavier components flow up heavier component conduit 449 into the annulus above barrier 439 to pump intake 419, bypassing bypass riser 427. The lighter components flow up bypass inlet tube 433 into and up bypass riser 431. A second separation occurs at bypass riser outlet 431, with a heavier portion of the lighter components flowing down to pump intake 419. The lighter components flow up the well.

Figure 5:
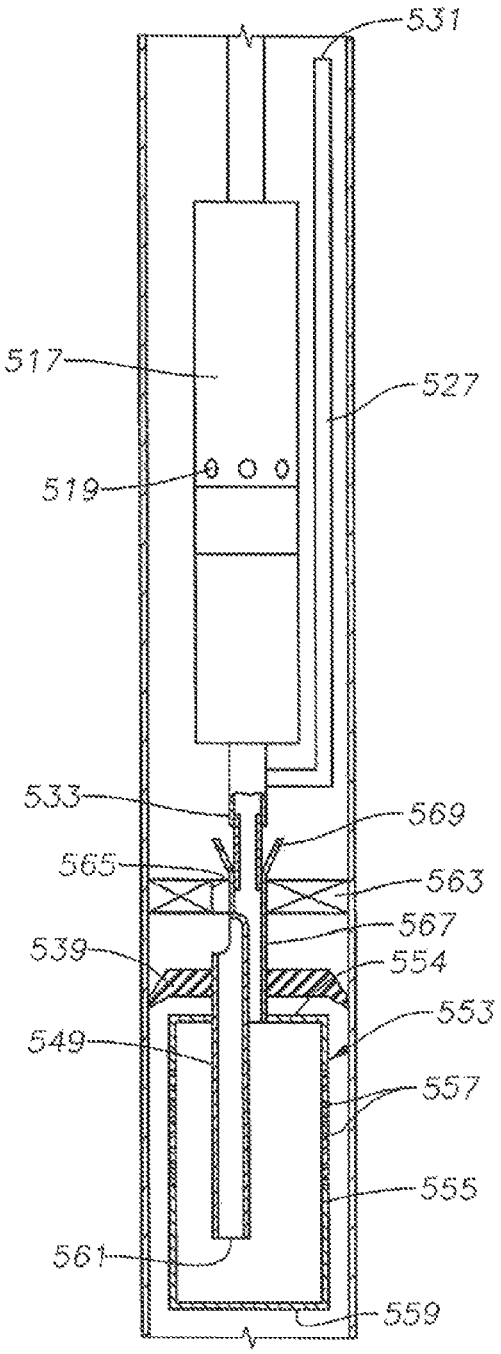
FIG. 5 is a schematic side view of a fifth embodiment of a pump assembly in accordance with this disclosure.

Referring to FIG. 5, pump 517 has a pump intake 519. A bypass riser 527 extends alongside pump 517 and has an outlet 531 above pump intake 519. A bypass riser inlet tube 533 joins the lower end of bypass riser 527 and extends downward. A heavier component conduit 549 extends upward through an optional barrier 539 that is shown as a cup seal.

A lower separator 553 is located below barrier 539. Lower separator 553 has a cylinder 555 with apertures 557 in its side wall. Cylinder 555 has a closed upper end 554 and a closed lower end 559. Heavier component conduit 549 has a heavier component port 561 on its lower end a short distance above closed lower end 559 and below apertures 557. Heavier component conduit 549 extends scalingly through barrier 539.

Another barrier 563, which is a weight supporting packer, is located above barrier 539 and below bypass riser 527. Barrier 563 has a heavier component passage 565 that allows the upward flow of heavier component well fluid from heavier component conduit 549 into the annulus above barrier 563. A lighter component conduit 567 extends from upper closed end 554 scalingly through barrier 539 and sealingly through another passage in barrier 563. Lighter component conduit 567 has a receptacle 569 on the upper side of barrier 563.

During installation of the system of FIG. 5, barriers 563, 539 and lower separator 553 are connected together on the surface, then lowered into the well as a unit and set. Then, the operator assembles pump 517, bypass riser 527 and bypass riser inlet tube 533 and lowers them as a unit into the well. Bypass riser inlet tube 533 stabs into receptacle 569.

In the operation of the embodiment of FIG. 5, well fluid flows in apertures 557 and undergoes a first separation as heavier components flow downward to heavier component port 561. The heavier components flow up heavier component conduit 549 into the annulus above barriers 539 and 563, then to pump intake 519, bypassing bypass riser 527. The lighter components flow up lighter component conduit 567 and bypass inlet tune 533 into bypass riser 527. A second separation occurs at bypass riser outlet 531, with a heavier portion of the lighter components flowing down to pump intake 519. The lighter portion of the lighter components exiting bypass riser 531 flow up the well.

While the disclosure has been shown in several of its forms, it should be apparent to those skilled in the art that various modifications may be made.

The invention claimed is:

1. A well pump assembly, comprising:

a pump adapted to be suspended on a string of production tubing within casing in a well, the pump having a pump intake and a pump discharge for discharging into the production tubing;

a motor operatively coupled to the pump for driving the pump;

a barrier that seals in the casing below the pump intake, defining an upper annulus in the casing in which the pump intake is located, the barrier having a heavier component passage and a lighter component passage, a lower separator located below the barrier, the lower separator having a labyrinth flow path that causes a separation of lighter components from heavier components of well fluid flowing into the lower separator, the lower separator having a heavier component port for discharging heavier components of well fluid into the heavier component passage of the barrier;

a bypass riser extending from below the pump intake to above the pump intake, the bypass riser having an inlet tube that leads to the lighter component passage in the barrier to receive lighter components of the well fluid separated by the lower separator, the bypass riser having a bypass riser outlet above the pump intake, causing a heavier portion of the lighter components flowing up the bypass riser to turn and flow downward at the bypass riser outlet into the upper annulus to reach the pump intake; and wherein the heavier component passage opens into the upper annulus for flowing heavier components of the well fluid separated by the lower separator into the upper annulus and up into the pump intake.

2. The assembly according to claim 1, wherein the lower separator has a lower separator inlet located above the heavier component port.

3. The assembly according to claim 1, wherein the lower separator has a lower separator inlet below the heavier component port.

4. The assembly according to claim 1, wherein the lower separator comprises:

a cylinder having a closed lower end and an inlet opening above the lower end; and a heavier component conduit located in the cylinder, the heavier component conduit having a heavier component opening adjacent and above the closed lower end that serves as the heavier component port of the lower separator, requiring well fluid flowing into the inlet opening of the cylinder to flow downward in the cylinder to reach the heavier component opening in the heavier component conduit.

5. The assembly according to claim 1, further comprising:

a lower barrier that seals in the casing below said first mentioned barrier, defining a lower end of a lower annulus that contains the lower gas separating device, the lower barrier having a lower barrier passage therethrough that delivers all of the well fluid flowing upward from below the lower barrier to the lower separator.

6. The assembly according to claim 5, wherein the lower separator causes lighter components of the well fluid to enter the lower annulus before flowing into the lighter component passage in said first mentioned barrier.

7. The assembly according to claim 1, wherein:

the lighter component passage in the barrier has a fixed flow area.

8. The assembly according to claim 1, wherein the lower separator comprises:

a lower labyrinth tube having an open upper end; and an upper labyrinth tube having an open lower end located below the upper end of the lower labyrinth tube and which serves as the heavier component port of the lower separator.

9. The assembly according to claim 1, wherein:

the lower gas separator has a closed upper end;

a heavier component conduit extends through the closed upper end to the heavier component passage in the barrier; and a lighter component conduit extends from the closed upper end to the lighter component passage in the barrier.

10. A well pump assembly, comprising:

a pump adapted to be suspended on a string of production tubing within casing in a well, the pump having a pump intake and a pump discharge for discharging into the production tubing;

a motor operatively coupled to the pump for driving the pump;

a barrier that seals in the casing below the pump intake, defining an upper annulus in the casing in which the pump intake is located, the barrier having a heavier component passage and a lighter component passage, the heavier component passage opening into the upper annulus:

a lower separator located below the barrier, the lower separator having a labyrinth flow path and a lower separator heavier component port, causing a first well fluid separation of lighter components from heavier components as well fluid flowing into the lower separator turns downward to flow toward the lower separator heavier component port;

a heavier component conduit extending from the heavier component of the lower separator to the heavier component passage in the barrier for discharging heavier components of well fluid separated by the lower separator into the upper annulus to flow up to the pump intake; and a bypass riser having a bypass riser inlet tube that leads to the lighter component passage in the barrier and a bypass riser outlet in the upper annulus above and in communication with the pump intake.

11. The assembly according to claim 10, wherein the lower gas separator comprises:

a cylinder having a side wall with apertures and a closed upper end;

the heavier component conduit extending downward through the closed upper end of the lower separator, the heavier component port being at a lower end of the heavier component conduit; and the riser inlet tube extending from the closed upper end of the lower separator through the lighter component passage in the barrier to the bypass riser, preventing lighter components separated by the lower separator from flowing into the upper annulus without first flowing through the bypass riser.

12. The assembly according to claim 10, further comprising:

a lower barrier that seals to the casing below the lower gas separator and said first mentioned barrier, the lower barrier having a well fluid passage;

the lower barrier and said first mentioned barrier defining a lower annulus in the casing that contains the lower separator; and wherein the first well fluid separation results in lighter components within the lower annulus.

13. The assembly according to claim 12, wherein the lower separator comprises:

a lower labyrinth tube extending upward from the well fluid passage in the lower barrier and having an open upper end in the lower annulus; and wherein the heavier component conduit comprises an upper labyrinth tube extending alongside the lower labyrinth tube.

14. The assembly according to claim 10, wherein the lower separator comprises:

a cylinder having an open upper end and a closed lower end, the heavier component conduit extending downward through the open upper end with the heavier component port being adjacent the closed lower end.

15. A method of pumping well fluid from a well, comprising:

suspending a pump on a string of production tubing within casing in the well;

installing a barrier in the carrier below a pump intake of the pump, defining an upper annulus in which the pump intake is located, the barrier component passage and a lighter component passage, mounting a static, gravity type lower separator below the barrier;

providing a bypass riser with a bypass riser inlet that leads to the lighter component passage and a bypass riser outlet in the upper annulus above and in communication with the pump intake;

flowing well fluid into the lower separator, then downward to a lower separator heavier component port, separating in a first well fluid separation lighter components from the heavier components as part of the well fluid turns to flow downward to the heavier component port;

flowing the heavier components that enter the heavier component port to the heavier component passage in the barrier, and discharging the heavier components from the heavier component passage into the upper annulus, and flowing the heavier components up the upper annulus to the pump intake; and flowing the lighter components to the bypass riser inlet and out the bypass riser outlet, separating in a second well fluid separation a lighter portion from a heavier portion of the lighter components, flowing the heavier portion of the lighter components down the upper annulus to the pump inlet and the lighter portion of the lighter components up the casing.

16. The method according to claim 15, further comprising:

maintaining a fixed flow area in the lighter component passage in the barrier.

17. The method according to claim 15, further comprising:

mounting a lower barrier sealingly in the casing below the lower separator and said first mentioned barrier;

the lower barrier defining a lower annulus in the casing between the lower barrier and said first mentioned barrier; wherein flowing the heavier components entering the heavier component port comprises flowing the heavier components through a heavier component conduit sealingly through the lower annulus and the heavier component passage in said first mentioned barrier into the upper annulus; and flowing the lighter components comprises flowing the lighter components from the lower annulus into a lighter component conduit that passes through the lighter component passage in said first mentioned barrier and sealingly through the upper annulus to the bypass riser inlet.

18. The method according to claim 15, further comprising:

mounting a lower barrier sealingly in the casing below the lower separator and said first mentioned barrier, the lower barrier defining a lower annulus in the casing between the lower barrier and said first mentioned barrier; and wherein the lower separator has a well fluid inlet in the lower annulus above the heavier component port.

19. The method according to claim 17, further comprising:

mounting a lower barrier sealingly in the casing below the lower separator and said first mentioned barrier;

the lower barrier defining a lower annulus in the casing between the lower barrier and said first mentioned barrier:

wherein the lower separator comprises:

a lower labyrinth tube having an open lower end below the lower barrier and an open upper end in the lower annulus; and an upper labyrinth tube that defines the heavier component conduit and has an open lower end below the open upper end of the lower labyrinth tube.

* * * * *